US005655607A

United States Patent [19]

Mellemstrand et al.

[11] Patent Number: 5,655,607

[45] Date of Patent: Aug. 12, 1997

[54] DOWNHOLE TOOL FOR PRESSURE TESTING OF OIL AND GAS WELLS

[75] Inventors: Jone Mellemstrand, Voll; Bernt Sigve Aadnøy, Sandnes; Svein Øritsland, Gausel; Jan Freyer, Hafrsfjord, all of Norway

[73] Assignee: Smedvig Technology AS, Forus, Norway

[21] Appl. No.: 505,237

[22] PCT Filed: Dec. 30, 1994

[86] PCT No.: PCT/NO94/00216

§ 371 Date: Aug. 9, 1995

§ 102(e) Date: Aug. 9, 1995

[87] PCT Pub. No.: WO95/18288

PCT Pub. Date: Jul. 6, 1995

[30] Foreign Application Priority Data

Dec. 30, 1993 [NO] Norway ..... 934916

[51] Int. Cl.[6] ..... E21B 33/127

[52] U.S. Cl. ..... 166/386; 166/187; 166/332.4; 166/387

[58] Field of Search ..... 166/187, 387, 166/385, 386, 332.4

[56] References Cited

U.S. PATENT DOCUMENTS

| | | | |
|---|---|---|---|
| 2,862,562 | 12/1958 | Hughes | 166/187 |
| 3,335,802 | 8/1967 | Seyffert, III | 166/332.4 |
| 3,529,665 | 9/1970 | Malone | 166/264 |
| 3,941,190 | 3/1976 | Conover | 166/187 |
| 4,648,448 | 3/1987 | Sanford et al. | 166/187 |

FOREIGN PATENT DOCUMENTS

| | | | |
|---|---|---|---|
| 167198 | 5/1965 | U.S.S.R. | 166/187 |
| 2217757 | 11/1989 | United Kingdom . | |
| 2219615 | 12/1989 | United Kingdom . | |

*Primary Examiner*—Hoang C. Dang

[57] ABSTRACT

A downhole tool for pressure testing of oil and gas wells comprises a generally tubular main tool (1), which is provided with an internal passage (2) and is arranged for attachment at the lower end of a drill pipe string. The main tool (1) is on its outside provided with an inflatable packing element (10), which may be supplied with and relieved of inflating medium via an annular slide valve (5) arranged inside the main tool (1). The slide valve has two active positions, one on each side of a closing initial position, and the slide valve is brought to the active positions by an auxiliary tool (18) which may be run into the passage (2) of the main tool and attached releasably in the slide valve (5). By pressure on the upper side of the auxiliary tool (18), the slide valve may be moved to one of its active positions against the action of a valve spring (6), and by traction in a cable attached to the auxiliary tool (18) the slide valve (5) may be moved to its other position against the action of the same valve spring (6). Upon completed pressure testing and relieving of the packing element (10), the auxiliary tool (18) may be freed from the slide valve (5) by varying the traction in the cable in order to release and free a locking mechanism (36–39) in the auxiliary tool (18), whereupon the latter may be pulled up to the surface.

10 Claims, 10 Drawing Sheets

DOWNHOLE TOOL FOR PRESSURE TESTING OF OIL AND GAS WELLS

The present invention relates to a downhole tool, e.g. for pressure testing of oil and gas wells, comprising a generally tubular main tool which is provided with an internal passage and is arranged to be attached between a drill pipe string and a drill bit or the like, said main tool on its outside being provided with an inflatable packing element which may be supplied with and relieved of inflating medium via an annular slide valve arranged internally in the main tool, said slide valve being movable against the action of a valve spring from a closing initial position to a first position wherein inflating medium may be supplied to the packing element and a second position wherein the inflating medium is permitted to leave the packing element, by means of at least one auxiliary tool which is lowerable through the drill pipe string at the end of a cable, the slide valve being provided with a central, through-going passage which has an inwardly extending shoulder against which a portion of the auxiliary tool may be brought to sealing abutment and by means of pressure move the slide valve in the direction towards the drill bit or the like to said first position.

Such a downhole tool is known e.g. from U.S. Pat. No. 3,529,665. Here, the slide valve is divided into two mutually axially movable parts, the lower part having a smaller internal diameter than the upper part. When the packing element is to be inflated, a first auxiliary tool is lowered which passes the upper part of the slide valve and comes to sealing abutment against a shoulder on the lower part, whereupon pressurizing of the drill string causes the first auxiliary tool to displace the lower part of the slide valve downwards against the action of the valve spring, so that a passage to the packing element is opened for inflating it. Upon completed pressure testing the first auxiliary tool is raised and replaced by an auxiliary tool having larger diameter, which upon being run down comes to rest against a shoulder on the upper part of the slide valve. Upon pressurizing the drill string, both the upper and lower parts of the slide valve are moved downwards against the action of the valve spring, thus opening a relieving passage from the packing element to the outside of the main tool via an annular space in the upper part of the slide valve. This structure is not known to be used in the oil industry, a possible explanation being that it is too complicated to use or that it cannot satisfy the strict reliability requirements imposed in offshore oil drilling. Furthermore, it will be difficult or impossible to use in deviation drilling or in horizontal wells.

It is therefore common to undertake formation strength testing only at the shoe of the casing pipe of the well. If, nevertheless, it is necessary to test an open hole, this is done by pulling the drill string out of the hole, dismantling the drill bit etc. and attaching an inflatable packing element to the drill string, which is again run down into the hole to the desired depth. The packing element is subsequently inflated in order to close the hole, whereupon pressure testing of the hole below the packing element may be performed. When the test has been performed, the packing element is deflated and the drill string is pulled out. The packing element is removed, the drill bit etc. installed and the drill string again run down into the hole to continue the drilling. This is a very time consuming and expensive process which therefore often is omitted, i.a. leading to reduced safety.

Thus, it is an object of the present invention to provide an improved tool of the above mentioned type which is well suited for horizontal wells and which, nevertheless, has a simple and reliable structure and is easy, safe and quick to use. It is also an object of the invention to provide a tool which has a wide field of application so that it i.a. may be used for selective pressure testing above or below the tool in an open hole, selective pressure testing above or below the tool in casing pipe, pressure testing of hole strength above or below the tool in order to determine formation strength, rock stresses, pore pressure, material properties, well fluid properties or other geological and rock mechanical parameters, initiation of fissures for later geophysical interpretation, and formation strength testing in the contact area of the packing element.

This is obtained according to the invention with a downhole tool of the type mentioned in the introduction, which is characterized in that the auxiliary tool is provided with means for releasable attachment in the slide valve and that the slide valve may be brought to said second position by means of tension in the cable and there will be located on the opposite side of its initial position with respect to its first position. This permits using one and the same auxiliary tool both for inflating and deflating the packing element and without having to remove the auxiliary tool during the testing.

An advantageous embodiment of the invention is characterized in that the auxiliary tool comprises a central rod which at its lower end is provided with an enlarged head for introduction into the central passage of the slide valve to said sealing abutment against said shoulder, and that a locking device is arranged axially movable under the action of spring force on the central rod and is provided with members which, when moved axially with respect to the head, cooperate with the head in order to fix or release, respectively, the head in the slide valve, said axial movements being obtainable on the one hand by means of pressure activation and on the other hand by means of varying tension in said cable. This provides for a simple operation which easily may be conducted in a safe manner.

For better understanding of the invention it will be described more closely with reference to the exemplifying embodiment shown in the appended drawings, where:

Both in this description and in the following claims the expressions "upper" and "lower" relate to a vertical application position of the downhole tool. This is not meant to constitute a restriction since the tool may function in any orientation.

Figure 1:
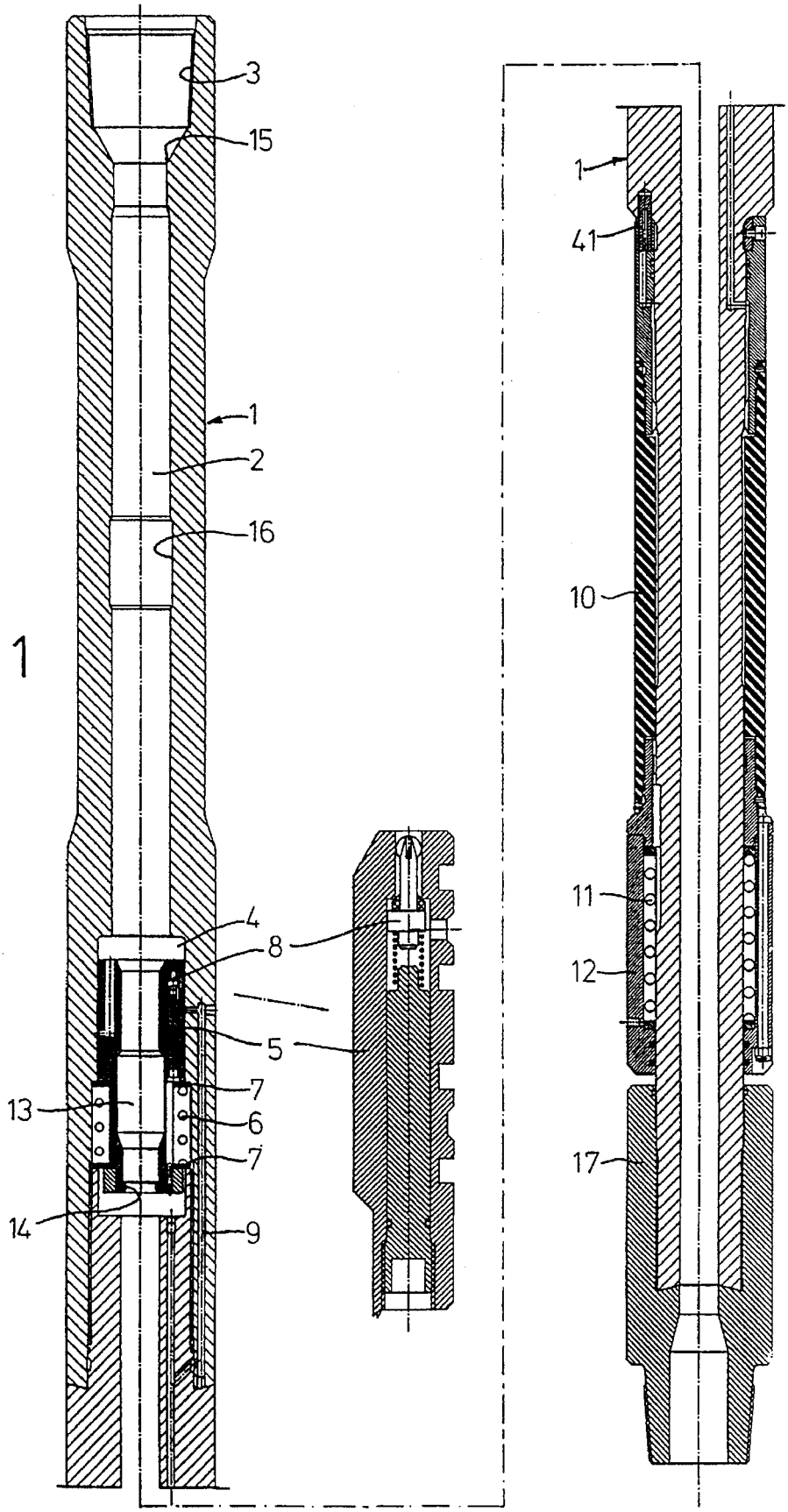
FIG. 1 shows a longitudinal section through a main tool for a downhole tool according to the invention.

First it is referred to FIG. 1, which shows a main tool 1 for a downhole tool according to the invention. The main tool is provided with an internal passage 2 and is at its upper end provided with internal conical threads 3 for screwing in the lower pin of a drill string (not shown). The drill string will have a somewhat larger internal diameter than the internal passage 2 of the main tool. The internal passage has an enlarged portion 4 wherein a slide valve 5 is slidably arranged and is held in a middle initial position by means of a valve spring 6. The spring acts between two support rings, which abut against both an inwardly extending collar in the main tool and an outwardly extending collar on the slide valve. The valve spring 6 is biased, e.g. with a force of 1750N for a tool having an external diameter of 7" (178 mm).

On its outer periphery the slide valve 5 has two axially spaced circumferential grooves, which through an internal passage each in the slide valve communicate with the internal passage 2 of the main tool. In one of the passages a non-return valve 8 is arranged to limit fluid flow to the direction from the internal passage of the main tool. By displacing the slide valve 5 to its upper or lower end positions, one or the other of the circumferential grooves will be brought in fluid communication with a connecting passage 9 leading to an inflatable packing element 10 arranged on the outside of the main tool 1 on a lower part of the latter having reduced diameter. In the deflated condition the packing element 10 is maintained in stretched condition by means of a spring 11 acting on a slidable end sleeve 12, so that the packing element 10 in inactive position has a somewhat smaller outer diameter than the largest diameter of the main tool 1. It will be seen that when the slide valve 5 moves to its lower position, a connection is established between the internal passage of the main tool and the connecting passage 9 for inflating the packing element since the non-return valve 8 only permits flow in the direction towards the packing element, while when the slide valve is located in its upper position, there is a free passage between the packing element and the internal passage 2 for deflating the packing element.

The slide valve 5 is provided with a central through-going passage 13, which at its lower end has an inwardly extending shoulder 14, the function of which will be explained in connection with FIGS. 3–10. Besides, it will be seen that when the slide valve 5 moves downwards or upwards from its initial position, in both cases the valve spring 6 will be compressed because one of the support rings 7 will remain stationary against the collar on the main tool while the other is moved by the slide valve.

At the upper end of the internal passage 2 the main tool 1 has a shoulder 15 and somewhat lower a slightly enlarged portion 16, the function of which also will be explained in connection with FIGS. 3–10. At its lower end the main tool has a lower sub 17, which e.g. may be connected to a drill bit or the like.

Figure 2:
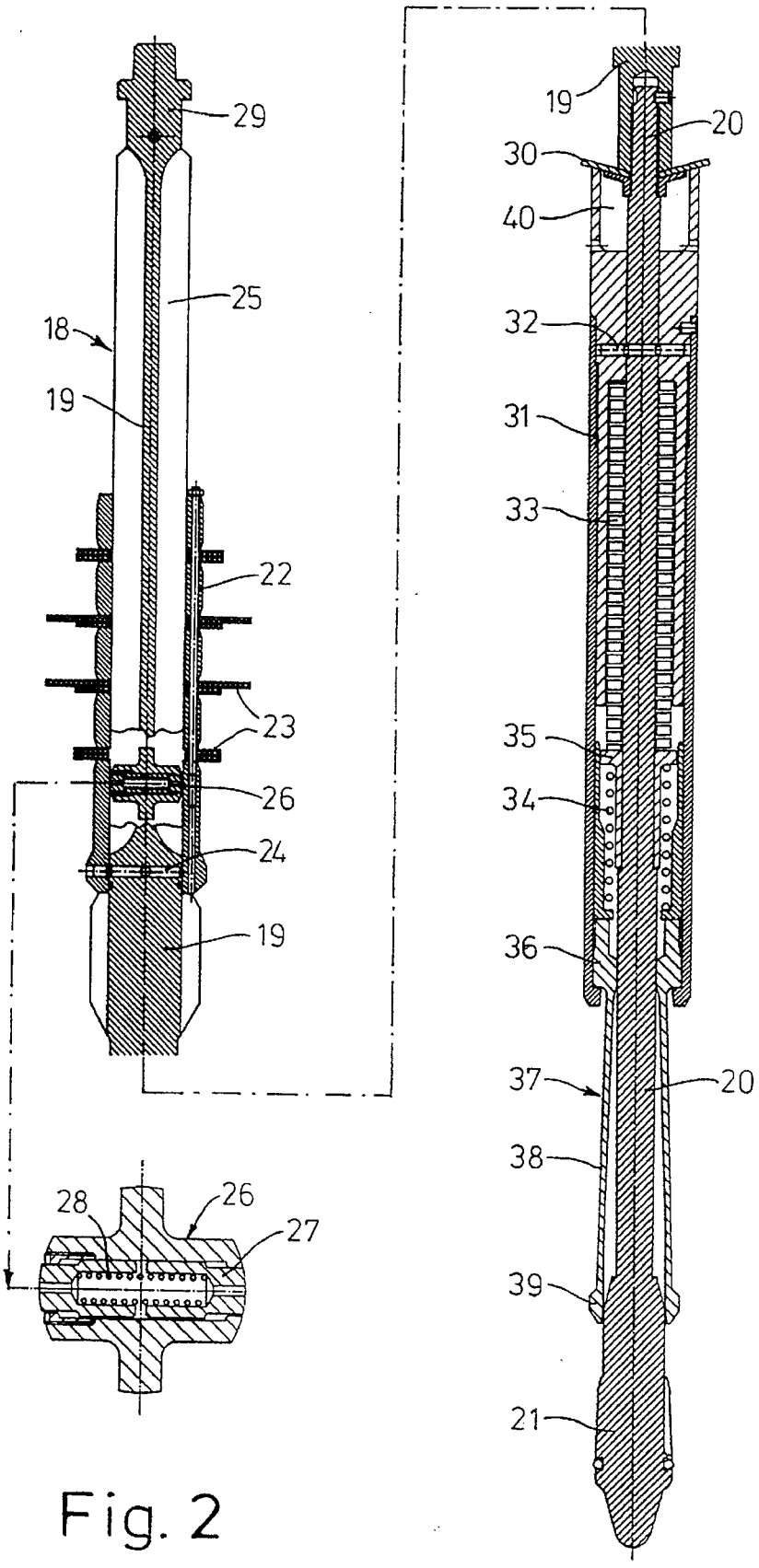
FIG. 2 shows a longitudinal section through an auxiliary tool for use together with the main tool in FIG. 1.

It is next referred to FIG. 2, where an auxiliary tool 18 for the downhole tool according to the invention is shown. The auxiliary tool has a central rod 19, 20 consisting of an upper part 19 and a lower part 20. The lower part is provided with an enlarged head 21 at its lower end, while the upper part 19 slidably receives a pumping down element 22 provided with several flexible seals 23 for sealing against the inside of the drill string during pumping down of the auxiliary tool. The pumping down element is fixed on the rod 19 by means of a shear pin 24, and on a portion above the shear pin the rod is provided with longitudinal recesses 25 which will form passages for drilling mud and well fluids past the pumping down element 22 when the latter is displaced a distance upwards along the rod as compared to the position shown in FIG. 2. Furthermore, the rod 19 has a portion 26 which, contrary to the rest of FIG. 1, is shown in radial section and is presented at a larger scale in a separate picture, contains two radially movable stopper pins 27, which biased by a spring 28 will be moved outwards when they are freed as the pumping down element 22 moves upwards along the rod 19. After they are freed these stopper pins 27 will prevent the pumping down element 22 from moving back down along the rod 19 far enough for the lower end of the longitudinal recesses 25 to be covered so that this flow passage is closed, as otherwise might happen during pulling up of the auxiliary tool. At its upper end the rod 19 is provided with an attachment 29 for e.g. a common tool running cable (not shown).

The lower part 20 of the central rod is at its upper end provided with a flexible seal 30 which acts as a piston for driving the auxiliary tool into the main tool after the shear pin 24 of the pumping down element 22 has been broken. The seal 30 rests against the upper end of a spring housing 31, which encloses the central rod 20 and is provided with a shear pin 32 fixing the spring housing against axial displacement on the rod. The spring housing 31 defines an annular space containing a main spring 33 and an oppositely acting secondary spring 34. These are with their one end resting against an interposed collar 35 having limited axial displaceability, while the opposite end of the secondary spring 34 acts on a portion 36 of a locking device 37 which is held with limited axial displaceability in the spring housing 31. The locking device 37 has arms 38 extending out from the spring housing 31 down to the head 21 on the lower part 20 of the central rod, the arms 38 being provided at their free end with a radial enlargement 39. At its opposite end the spring housing 31 is provided with a cavity 40, into which the seal 30 may be pulled under deformation and be made inactive as a piston when the spring housing moves under the influence of the main spring 33 along the rod 20 following shearing of the shear pin 32. This avoids the packing 30 forming a brake during the pulling up of the auxiliary tool.

It will be seen that the auxiliary tool may be divided at the transition between the upper part 19 and the lower part 20 of the central rod. The upper part is used when the auxiliary tool is to be pumped down to the main tool, e.g. for deviating or horizontal wells, while if the well is approximately vertical, the lower part may be replaced by a suitable weight (not shown).

The operation of the tool according to the invention shall now be described with reference to FIGS. 3–10. It is pointed out that the drill string to which the tool is attached, is deleted in these drawings, which causes the pumping down element of the auxiliary tool to be shown in its undeformed condition, while its flexible seals 23 actually would lie bent upwards in the central cavity of the drill string. Besides, the cable that has to be attached to the upper end of the auxiliary tool is not shown, and in order to save space, the lower part of the main tool with the inflatable packing element is not shown either. As regards the reference numerals to be used in the following description, it is referred to FIGS. 1 and 2.

Figure 3:
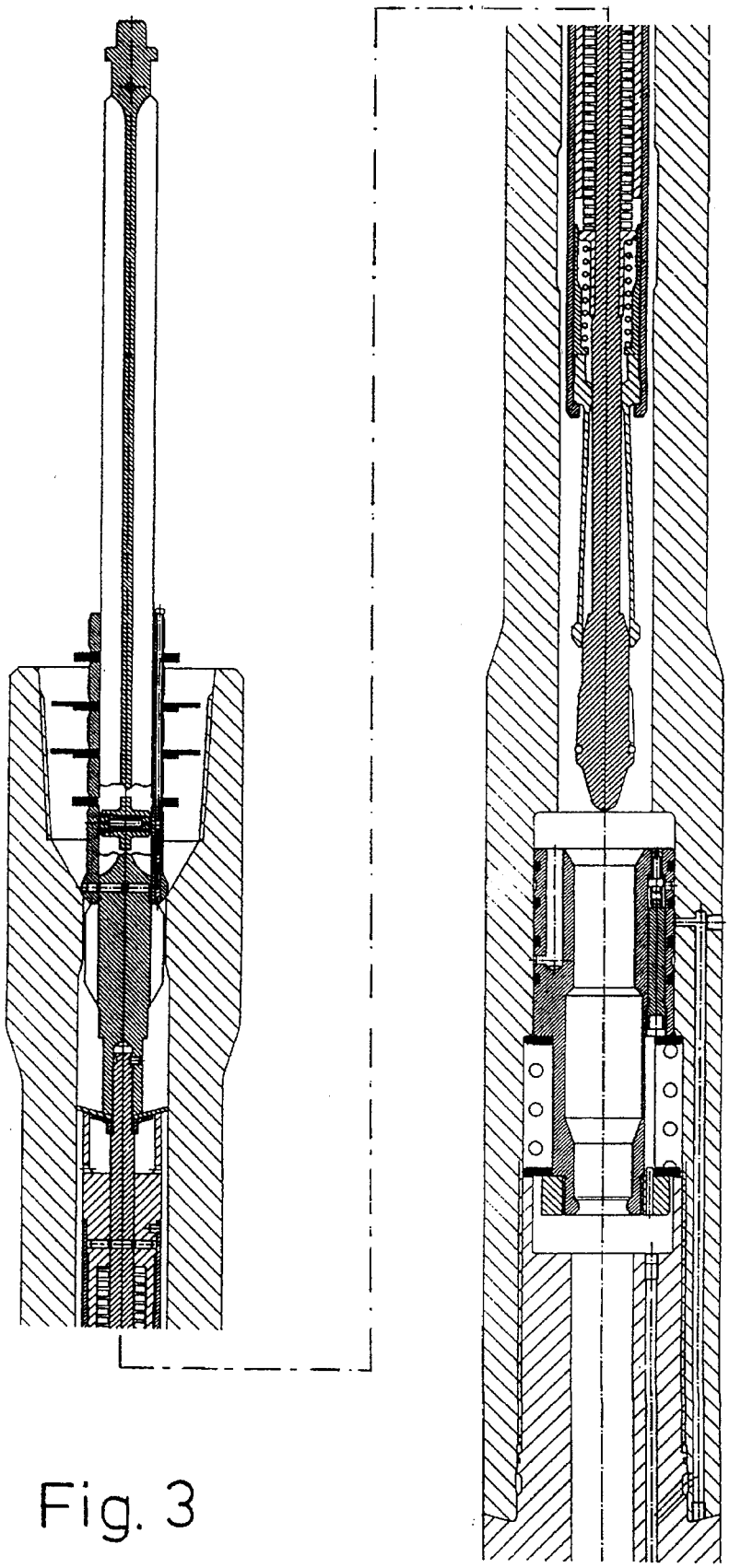
FIGS. 3–10 are longitudinal sections showing the auxiliary tool in FIG. 2 located in the main tool of FIG. 1 and illustrate various steps of the use of the downhole tool according to the invention.

In FIG. 3 the auxiliary tool 18 has been run as far down into the main tool I that the lower end of the pumping down element 22 has come to rest against the upper shoulder 15 of the main tool 1. Here, the auxiliary tool is in the same condition as in FIG. 2, and for a tool of the dimension mentioned in connection with FIG. 1 above, the biasing force of the main spring 33 and the secondary spring 34 may e.g. be 1581N and 374N, respectively. The radial enlargements 39 on the locking arms 38 rest against a portion of the head 21 having an intermediate diameter.

Figure 4:
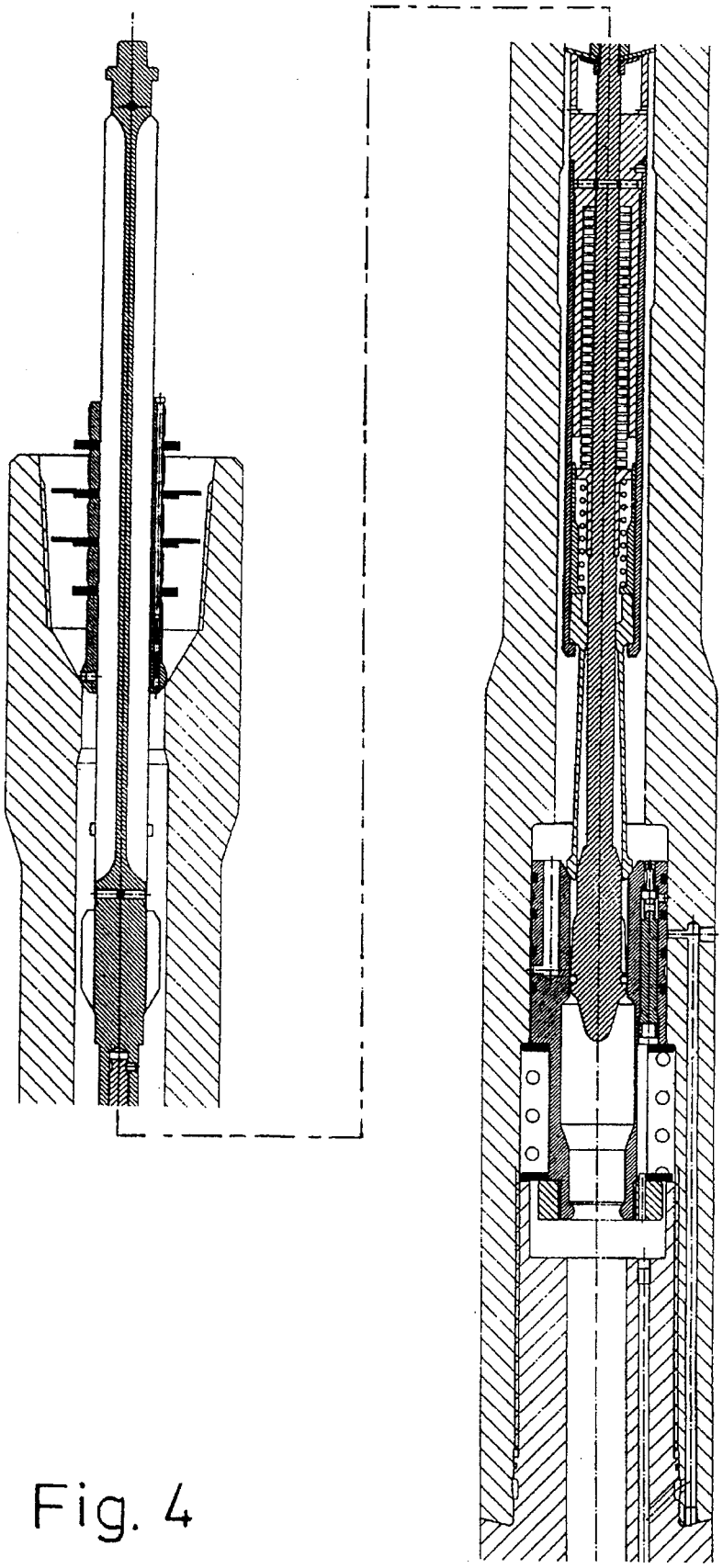

In FIG. 4 the auxiliary tool has been moved a further distance into the main tool by means of pumping and/or the momentum of the auxiliary tool. The shear pin 24 has been sheared and the pumping down element 22 has been left hanging on the shoulder in the main tool. The head 21 of the central rod of the auxiliary tool has penetrated partly into the central passage 13 in the slide valve 5, and the radial enlargements 39 on the locking arms have come to abutment against the upper end of the slide valve.

Figure 5:
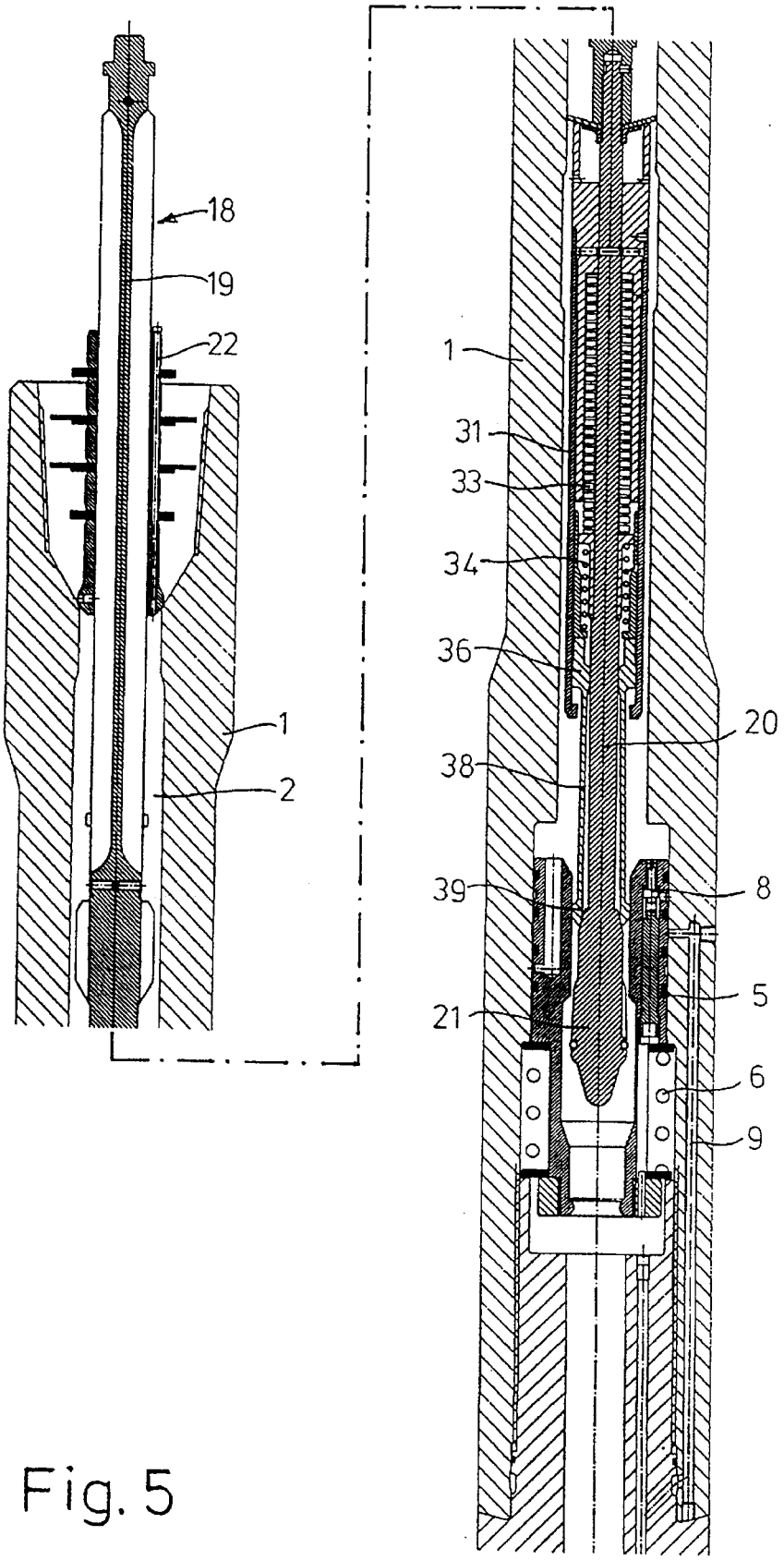

FIG. 5 shows the situation after further pumping has taken place. The head 21 of the auxiliary tool has penetrated even further into the passage in the slide valve, the locking device 36–39 having been pushed somewhat upwards against the action of the secondary spring 34, the force of which now has increased to 561N. The free ends of the locking arms 38 have thus come to rest against a narrower portion of the head 21, their enlargements 39 having been pushed sufficiently inwards to be able to pass the upper edge of the slide valve and into its central passage.

Figure 6:
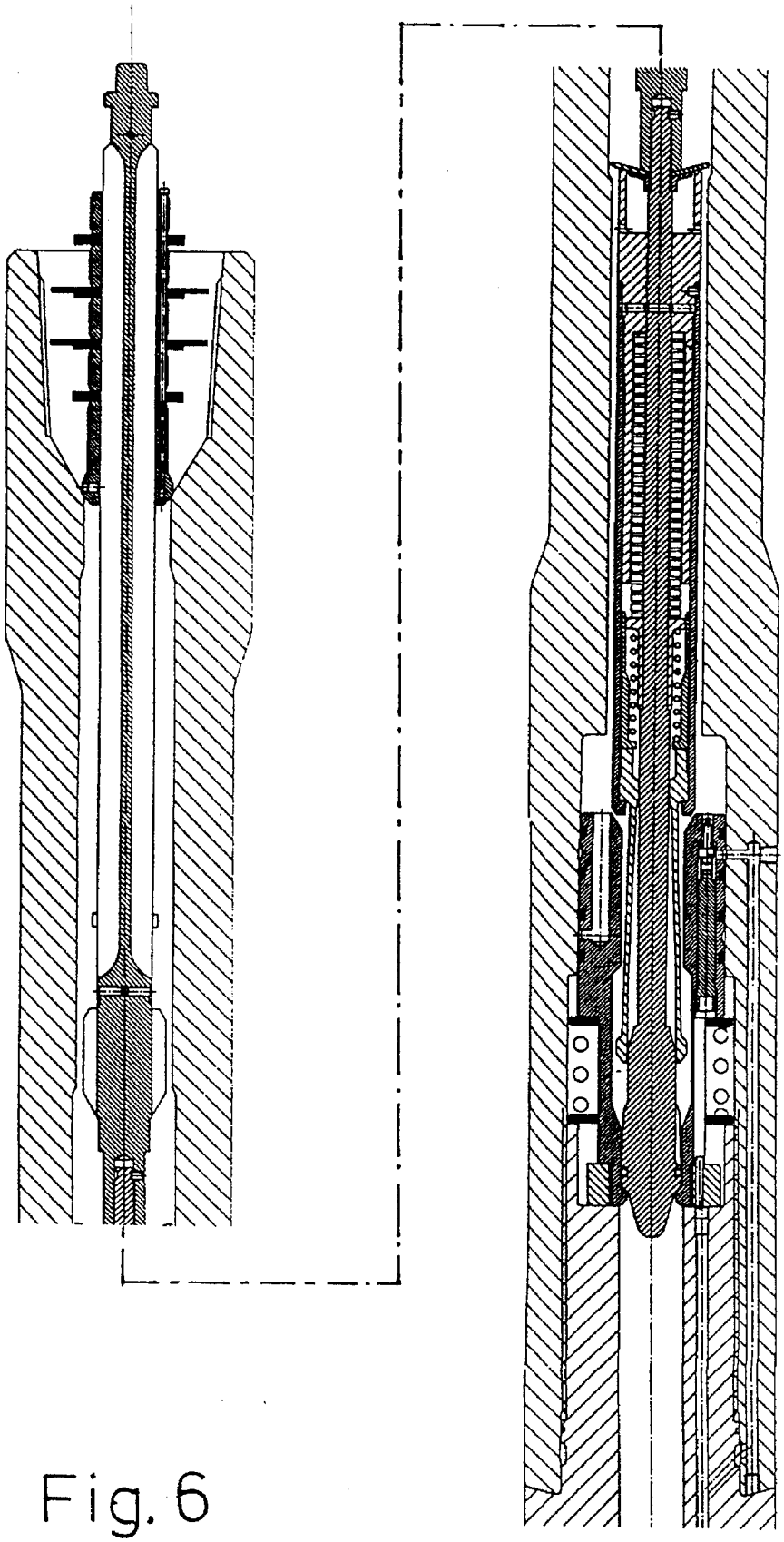
Figure 7:
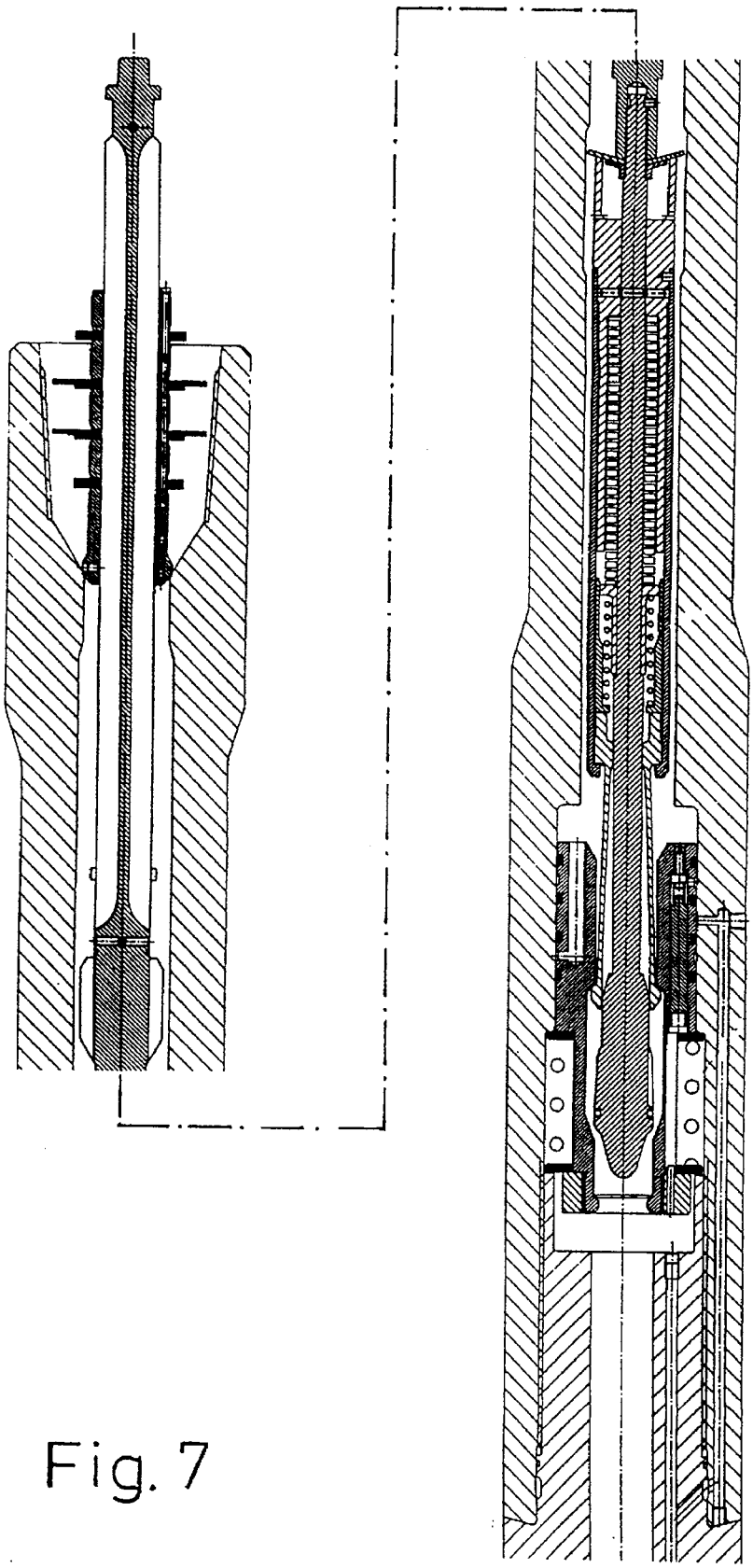

In FIG. 6, further pumping has brought the head 21 to sealing abutment against the inwardly extending shoulder 14 in the slide valve, and the enlargements 39 have passed the narrowest portion of the central passage of the slide valve so that they have resumed their initial position and the secondary spring has gone back to its resting position. Furthermore, the pumping has led to the slide valve having been moved to its lower position, and the circumferential groove on the slide valve connected to the non-return valve 8 has been brought in contact with the connecting passage 9 leading to the inflatable packing element. The pressure in the internal passage 2 of the main tool is thus transmitted to the packing element for inflating same. The magnitude of the inflating pressure is regulated by a drilling mud/cement pump on the surface. With the slide valve in its lower position the force of the valve spring 6 is increased from 1750N to 2600N.

In all four steps shown in FIGS. 3–6 there has been no pull in the cable connected to the upper end of the auxiliary tool.

When sufficient pressure has been obtained in the inflatable packing element so that it seals as desired against the bore hole wall, a pull of about 1000N is exerted in the cable. This leads to the situation shown in FIG. 7. Here, the head 21 of the auxiliary tool has been moved away from its seat against the shoulder 14 in the slide valve, but the head is still held in the central passage of the slide valve since the locking enlargements 39 have come to abutment against the lower edge of the upper, narrower passage of the slide valve. The slide valve has been moved back to its middle initial position by the valve spring 6 and will remain in this position notwithstanding the action of the cable tension because the latter is only about 1000N while the biasing force of the valve spring is 1750N. With the auxiliary tool in this position, there will be free passage for drilling mud down to the bottom of the well, e.g. due to the position of the seal 30 in the somewhat enlarged portion 16 of the internal passage 2 of the main tool. In this situation pressure testing of the formation, for example, may be performed.

Figure 8:
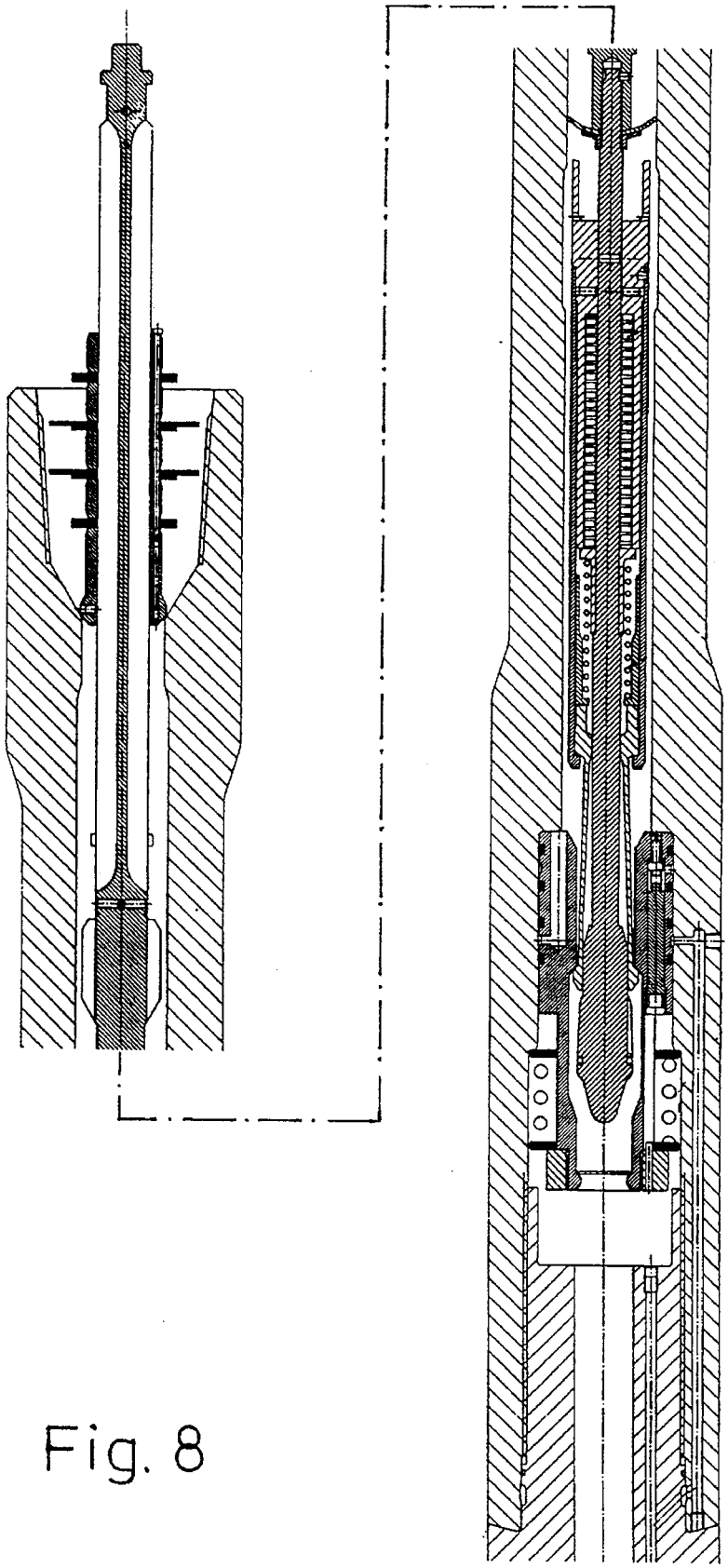
Figure 9:
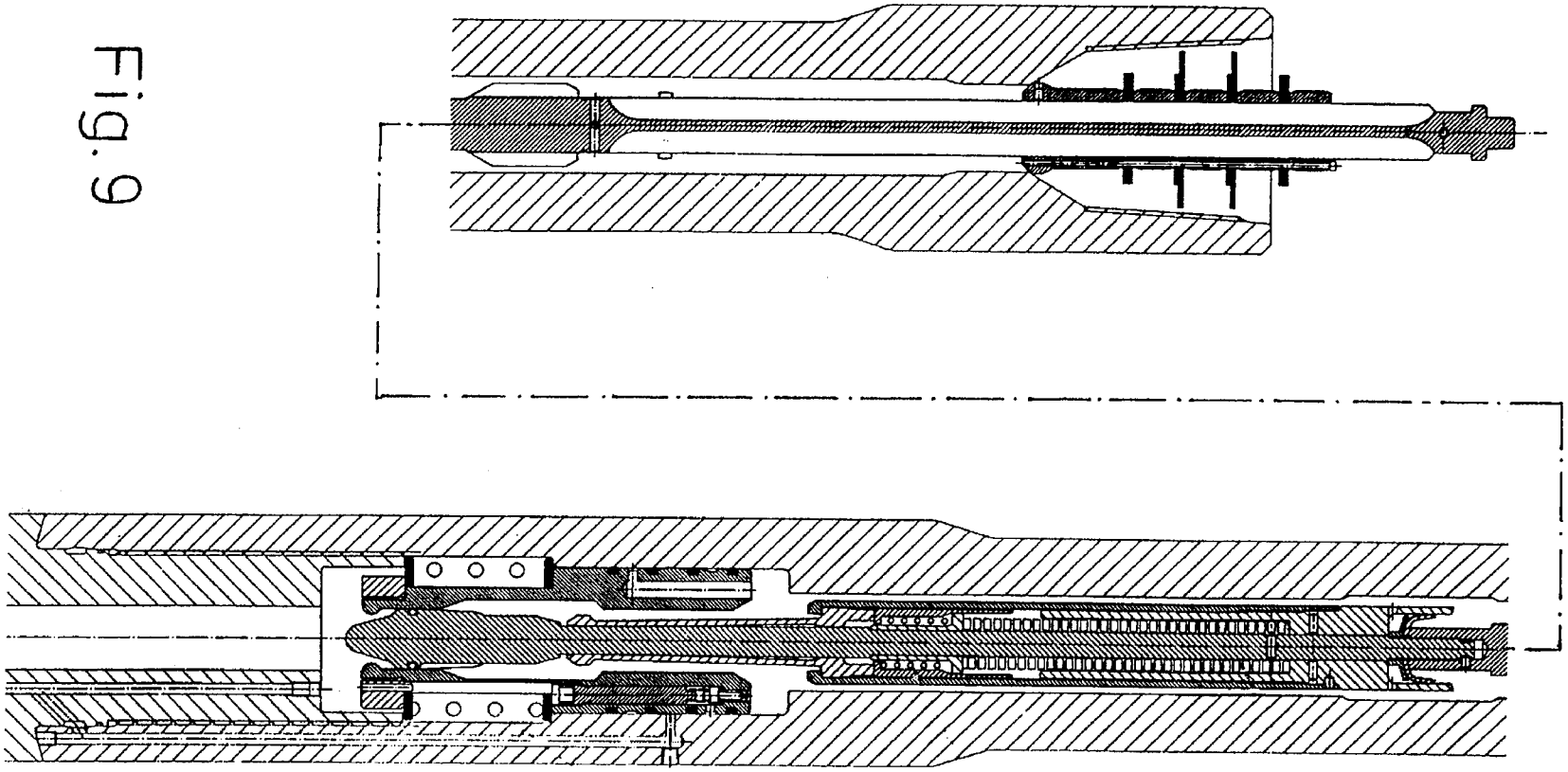

Upon completed testing the traction in the cable is increased to about 3000N. This pulls the slide valve to the upper position by means of the locking enlargements 39. This position of the slide valve is shown in FIG. 8 and provides passage for the inflating fluid in the packing element to the internal cavity of the main tool so that the packing element 10 is brought to resume its initial position by means of the spring 11. With the slide valve still in the upper position, the cable traction is increased to about 5000N, so that the shear pin 32 holding the spring housing 31 to the lower part 20 of the central rod of the auxiliary tool, is sheared, whereby the situation shown in FIG. 8 occurs. Under these circumstances the force in the main spring 33 will be 2356N and in the secondary spring 140N. In the next step, which is illustrated in FIG. 9, the pull in the cable is slackened. The main spring 33, which now is free at its upper end, pushes the central rod of the auxiliary tool downwards until the upper end of the spring housing comes to rest against the seal 30, which at the same time is pulled into the cavity 40 of the spring housing. Concurrently the enlargements 39 of the locking arms 38 move free of the enlarged head 21 so that it will no longer be locked in the slide valve which, moreover, has moved back to its initial position.

Figure 10:
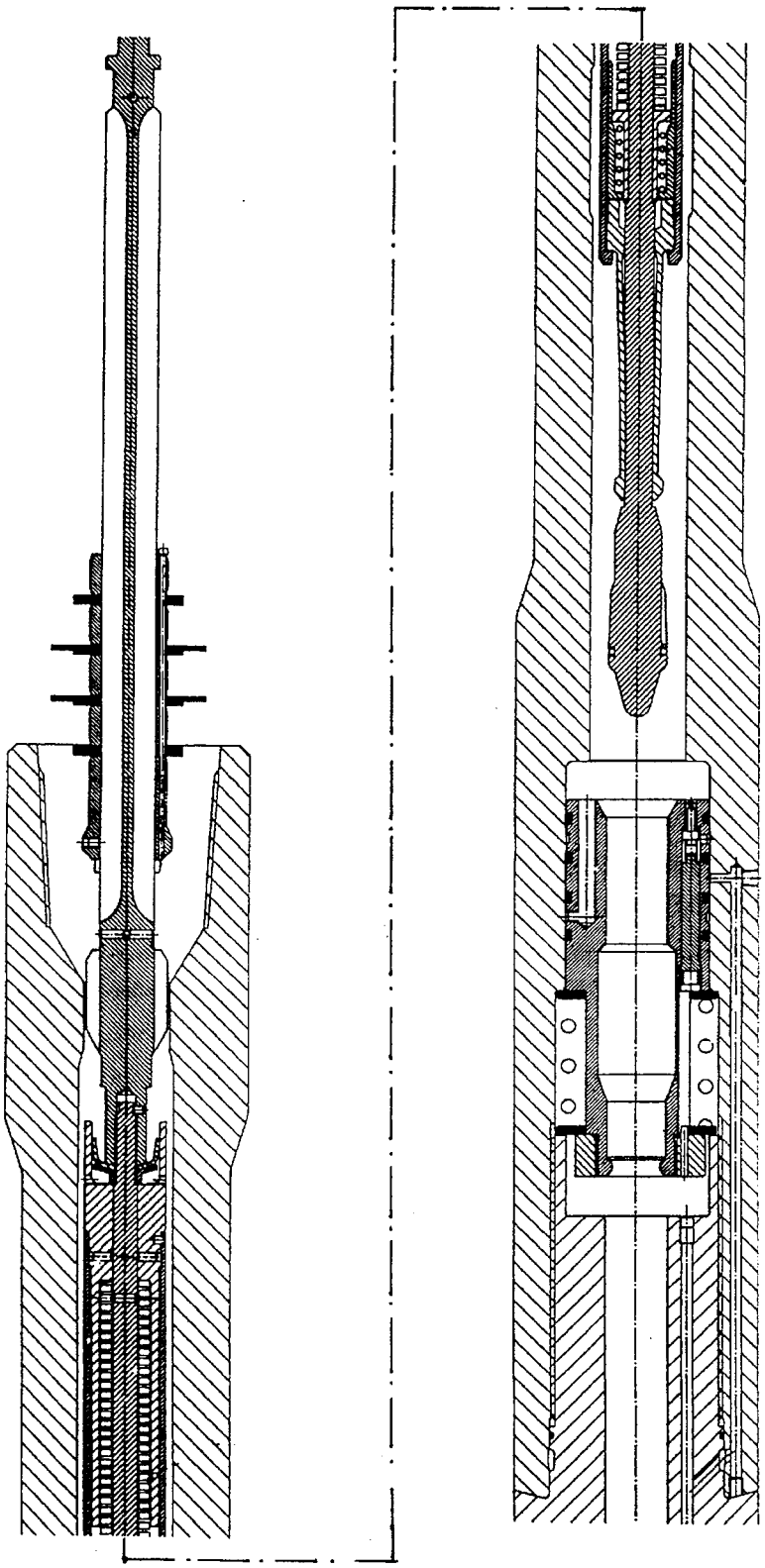

In the last step, which is illustrated in FIG. 10, the auxiliary tool is pulled out of the main tool and further up to the surface, where the auxiliary tool may be readied for further use by inserting new shear pins 24 and 32. From FIG. 10 it may be seen that during the pulling up, the lower end of the pumping down element 22 has come to rest against the extending stopper pins 27, thus making an open passage inside the pumping down element through the longitudinal recesses 25 in the upper rod 19. Since the seal 30 has been pulled into the cavity 40 of the spring housing, it will not present any resistance against the pulling up either.

In case malfunctioning or blocking of the valve system should occur during use of the tool, or the cable should be pulled apart while the packing element is inflated, a hollow shear pin 41 (FIG. 1) has been included in the upper end of the packing element as a safety precaution in order to facilitate emptying of the packing element. The packing element may be emptied through the hollow shear pin upon its shearing by rotation of the drill string.

It will be understood that the invention is not limited to the exemplifying embodiment described, but may be varied and modified in a number of ways within the inventive idea and the scope of the following claims.

We claim:

1. A downhole tool comprising a generally tubular main tool (1) which is provided with an internal passage (2) and is arranged to be attached between a drill pipe string and a drill bit, said main tool (1) on its outside being provided with an inflatable packing element (10) which may be supplied with and relieved of inflating medium via an annular slide valve (5) arranged internally in the main tool (1), said slide valve (5) being movable against the action of a valve spring (6) from a closing initial position to a first position wherein inflating medium may be supplied to the packing element (10) and a second position wherein the inflating medium is permitted to leave the packing element, by means of at least one auxiliary tool (18) which is lowerable through the drill pipe string at the end of a cable, the slide valve (5) being provided with a central, through-going passage (13) which has an inwardly extending shoulder (14) against which a portion (21) of the auxiliary tool (18) may be brought to sealing abutment and by means of pressure move the slide valve (5) in the direction towards the drill bit to said first position, characterized in that the auxiliary tool (18) is provided with means (31–39) for releasable attachment in the slide valve (5) and that the slide valve (5) may be brought to said second position by means of tension in the cable and there will be located on the opposite side of its initial position with respect to its first position.

2. A downhole tool according to claim 1, characterized in that the auxiliary tool (18) comprises a central rod (19, 20) which at its lower end is provided with an enlarged head (21) for introduction into the central passage (13) of the slide valve (5) to said sealing abutment against said shoulder (14), and that a locking device (36–39) is arranged axially movable under the action of spring force on the central rod (19, 20) and is provided with members (39) which, when moved axially with respect to the head (21), cooperate with the head in order to fix or release, respectively, the head in the slide valve (5), said axial movements being obtainable on the one hand by means of pressure activation and on the other hand by means of varying tension in said cable.

3. A downhole tool according to claim 2, characterized in that a lower part (20) of the central rod (19, 20) the auxiliary tool (18) is enclosed by a spring housing (31) which is provided with a shear member (32) fixing the spring housing against axial displacement on the lower part (20), said spring housing (31) defining an annular space containing a main spring, (33) and an oppositely acting secondary spring (34), said springs being supported at their one end against an interposed collar (35) with limited axial mobility, the opposite end of the secondary spring (34) biasing the locking device (36–39), which has a portion (36) which is held captive with limited axial mobility in the spring housing (31).

4. A downhole tool according to claim 3, characterized in that the lower part (20) of the central rod (19, 20) of the auxiliary tool (18) is provided with a flexible seal (30) acting as a piston for driving the auxiliary tool into the main tool (1).

5. A downhole tool according to claim 4, characterized in that the spring housing (31) at its upper end is provided with a cavity (40) for receiving said seal (30) acting as a piston in order to make the piston inactive when the spring housing (31) is moved under the influence of the main spring (33) after the shear member (32) of the spring housing having been sheared.

6. A downhole tool according to one of claims 2–5, characterized in that the auxiliary tool (18) is provided with a pumping down element (22) which is attached to an upper part (19) of the central rod (19, 20) of the auxiliary tool by means of a shear member (24).

7. A downhole tool according to claim 6, characterized in that the Upper part (19) of the central rod, on a portion above the shear member (24), is provided with longitudinal recesses (25) forming passages for drilling mud and well fluids upon relative displacement of the pumping down element (22) upwards along the central rod (19, 20).

8. A downhole tool according to claim 7, characterized in that the portion of the upper part (19) of the central rod (19, 20) having longitudinal recesses (25) is provided with radially movable stopper elements (27) which, under the influence of a spring (28), will be moved outwards when they are freed by the upwards movement of the pumping down element (22) along the central rod (19, 20), thereby limiting the movement of the pumping down element along the central rod (19, 20) in the opposite direction during pulling up of the auxiliary tool (18).

9. A downhole tool according to claim 1, characterized in that the valve spring (6) is arranged to move the slide valve (5) towards its initial position both from its first and its second positions.

10. A method for pressurizing and relieving an inflatable packing element (10) on a downhole tool for pressure testing of an oil or gas well, said downhole tool comprising a main tool (1) carried by a drill string at its lower end and comprising the packing element (10) on its outside, wherein the packing element is supplied with and relieved of inflating medium via a slide valve (5) displaceably arranged in the main tool, said slide valve being mowed from a closing initial position to a first position wherein inflating medium may be supplied to the packing element (10) and a second position wherein inflating medium is permitted to leave the packing element, by means of at least one auxiliary tool (18) which is run down through the drill string at the end of a cable, said auxiliary tool being brought to sealing abutment against an inwardly extending shoulder (14) in a central, through-going passage (13) in the slide valve so that the slide valve may be moved at least to said first position by means of pressure on the upper side of the auxiliary tool (18), characterized in that the auxiliary tool (18) is releasably attached in the slide valve (5) and that the slide valve is brought to said second position by means of traction in the cable and is thereby moved to the opposite side of its initial position as compared to its first position.

* * * * *

UNITED STATES PATENT AND TRADEMARK OFFICE

CERTIFICATE OF CORRECTION

PATENT NO. : 5,655,607

DATED : Aug. 12, 1997

INVENTOR(S) : Mellemstrand et al.

It is certified that error appears in the above-indentified patent and that said Letters Patent is hereby corrected as shown below:

| | |
|---|---|
| Column 7, line 27 | Replace "Upper"<br>With --upper-- |
| Column 8, line 18 | Replace "mowed"<br>With --moved-- |

Signed and Sealed this

Tenth Day of February, 1998

*Attest:*

*Attesting Officer*

BRUCE LEHMAN

*Commissioner of Patents and Trademarks*